US011642588B2

(12) United States Patent
Parker

(10) Patent No.: US 11,642,588 B2
(45) Date of Patent: May 9, 2023

(54) GRIP ASSIST APPARATUS WITH SPINE INSERT

(71) Applicant: Power Gripps USA, Inc., Sorrento, ME (US)

(72) Inventor: Michael S. Parker, Sorrento, ME (US)

( * ) Notice: Subject to any disclaimer, the term of this patent is extended or adjusted under 35 U.S.C. 154(b) by 137 days.

(21) Appl. No.: 16/855,940

(22) Filed: Apr. 22, 2020

(65) Prior Publication Data

US 2021/0069575 A1 Mar. 11, 2021

Related U.S. Application Data

(60) Provisional application No. 62/898,104, filed on Sep. 10, 2019.

(51) Int. Cl.
*A63B 71/14* (2006.01)
*A41D 19/015* (2006.01)

(52) U.S. Cl.
CPC ..... *A63B 71/14* (2013.01); *A41D 19/01564* (2013.01); *A41D 19/01588* (2013.01); *A63B 2244/09* (2013.01)

(58) Field of Classification Search
CPC . A63B 71/14; A63B 2244/09; A63B 21/4021; A63B 71/141; A41D 19/01588; A41D 19/01564; A41D 13/082
USPC ..... 428/93; 2/20, 161.1, 162, 16, 170; 602/21
See application file for complete search history.

(56) References Cited

U.S. PATENT DOCUMENTS 4,138,108 A * 2/1979 Robinson ..... A63B 71/14 273/DIG. 30
4,926,501 A * 5/1990 Goosen ..... A63B 71/1225 2/22
5,350,343 A * 9/1994 DaSilva ..... A41D 13/082 2/20
5,453,064 A * 9/1995 Williams, Jr. ..... A63B 23/16 2/161.1
5,733,249 A * 3/1998 Katzin ..... A61F 5/0106 602/21
5,745,920 A * 5/1998 Olivier ..... A63B 21/4021 2/161.1
5,813,950 A * 9/1998 Parker ..... A41D 13/082 2/20
5,888,180 A * 3/1999 Dewberry ..... A63B 21/4019 482/139
10,098,393 B2 8/2018 Parker
2011/0214220 A1* 9/2011 Parker ..... A63B 21/4021 2/161.1
2013/0152290 A1* 6/2013 Chou ..... A41D 13/0575 2/463
2013/0337927 A1* 12/2013 Buchanan ..... A63B 69/0059 473/213
2015/0057133 A1* 2/2015 Nguyen ..... A63B 21/4021 482/93

(Continued)

*Primary Examiner* — Nathan E Durham
*Assistant Examiner* — Abby M Spatz
(74) *Attorney, Agent, or Firm* — Catherine Napjus; Michael Persson; Chisholm, Persson & Ball, PC

(57) ABSTRACT

A grip assist apparatus for weightlifting that includes a gripping portion with spine insert that is sufficiently pliable to be bent to allow a user to reach the end with their fingers and wrap the gripping portion around an axle bar but sufficiently resilient to substantially return to its starting position after the gripping portion is released.

23 Claims, 3 Drawing Sheets

(56) References Cited

U.S. PATENT DOCUMENTS

2015/0367167 A1* 12/2015 Swaby ..... A63B 71/14
482/92

* cited by examiner

GRIP ASSIST APPARATUS WITH SPINE INSERT

CLAIM OF PRIORITY

This application claims the benefit of priority of U.S. Provisional Patent Application Ser. No. 62/898,104, filed on Sep. 10, 2019.

FIELD OF THE INVENTION

The present invention relates to the field of strength training and weight lifting and, in particular, to grip assist apparatus for use therein.

BACKGROUND

Strength training has become a widely practiced activity for both men and women. In addition to being a sport in and of itself, strength training is also utilized as a conditioning and strengthening exercise for other sports, such as football, basketball, and baseball. Furthermore, athletes who rely on agility, such as tennis players, also benefit from strength training.

In sports, protective equipment is utilized to prevent injury to the participant. With respect to strength training, protective equipment is also needed, as all the joints of the body may be subjected to extreme forces. In particular, the wrist joint is subjected to these extreme forces any time the trainee's hands utilize a weight bar during the course of strength training.

The present inventor has developed several advancements in the protection of the hand and wrists during weight lifting. Some of these advancements are represented in U.S. Pat. Nos. 5,813,950 and 10,098,393 and U.S. patent application Ser. No. 12/660,856, each of which is hereby incorporated by reference, and will be referred to herein as the "inventor's prior art." One of at least ordinary skill in the art will recognize that some aspects or details discussed in each of these disclosures, but not discussed herein, may be applicable to the present invention.

What none of the prior art addresses, including the inventor's prior art, is protecting the hand and wrist when using heavier weights that necessitate a bar with a larger diameter. As used herein, the term "axle bar" refers to a weightlifting bar that has a diameter of 2 inches or more. Axle bars are commonly utilized in the strongman community to hold heavy weights for exercises such as deadlifts, where a standard bar may flex due to the amount of weight at each end. The inventor's prior art discloses weightlifting grips designed for standard bar sizes with diameters less than 2 inches. With such standard bars, the inventor's prior art allows the user to wrap the grip around the bar by catching the end of the grip with her fingertips. The size of an axle bar would prevent many users from being able to use such grips because the grip might not be long enough to wrap around the axle bar; the user's fingers might not be long enough to reach the end of the grip around an axle bar; or the very material that make the grips stiff enough to be accessible to the fingertips with a normal bar might make the grips stick out from the axle bar so that it cannot be reached with the axle bar. The same gripping and protective advantages that the inventor's prior art provides for normal bar sizes is also needed when using axle bars, however. Therefore, there is a need for a grip assistance apparatus that may be used with axle bars.

SUMMARY OF THE INVENTION

The present invention is a grip assist apparatus for weightlifting that includes a gripping portion with spine insert that is sufficiently pliable to be bent to allow a user to reach the end with their fingers and wrap the gripping portion around an axle bar but sufficiently resilient to substantially return to its starting position after the gripping portion is released.

The grip assist apparatus includes a gripping portion, which covers at least the palm of hand when worn as intended, and a wrist portion attached to the gripping portion. The wrist portion includes straps and fastening means for fastening the wrist portion around the user's wrist, thereby allowing the gripping portion, attached thereto to be held against the user's hand. The gripping portion is made of at least two halves or layers. The gripping portion is preferably made of a single flat piece of material that is folded along a line of symmetry. It is understood, however, that the gripping portion may be made of two separate pieces of material that are affixed to one another so as to be flush with one another except where one or more inserts may be included between the two halves. The gripping portion has a finger end at the top with a finger end width, a wrist end opposite from the finger end, attachment edges near the wrist end, for attaching the straps of the wrist portion, and first and second sides between the finger end and the attachment edges. A side length is measured from the center point of the wrist end to a center point of the finger end.

The gripping portion also includes a spine insert between the two halves. The label "spine insert" does not necessarily indicate a rigid insert, as discussed below. The spine insert is disposed roughly perpendicular to the finger end and roughly parallel to and centered between the first and second sides, understanding that the first and second sides are not necessarily perfectly straight parallel lines. For example, the first and second sides may include thumb contouring and/or non-thumb contouring toward the wrist end, but above such contouring, toward the finger end, the first and second sides are parallel. In such a case, it is understood that the spine insert is parallel to the portion of the first and second sides that is parallel. The spine insert has a finger tip disposed toward the finger end of the gripping portion and wrist tip disposed toward the wrist end of the gripping portion. The finger tip of the spine insert does not necessarily extend all the way to the finger end, but preferably just shy of the end piece discussed below. The spine insert preferably extends to or near to the wrist end.

The spine insert may be made of any material that will allow the gripping portion to maintain a curl long enough that a user may grasp the axle bar and catch the finger end of the gripping portion with her finger tips. As such, the spine insert must have at least some rigidity that combined with the rigidity of the gripping portion will achieve this effect, but primarily needs to be flexible. The spine insert may be a long thin piece of metal that is both pliable and resilient. Such a metal spine insert is made from annealed spring steel but it is understood that other materials may utilized to achieve similar results. The spine insert may also be made of silicone rubber, polychloroprene, polypropylene, or styrene butadiene rubber, collectively referred to herein as "red rubber." The spine insert may also be made of cardboard or other types of rubber. Any such material that is flexible and durable may be used.

In preferred embodiments, the spine insert is made of polypropylene webbing. An example of the preferred webbing is sold under the trademarks STRAPWORKS HEAVY- WEIGHT PROPYLENE WEBBING. It is often used as strapping in outdoor applications. It is not stretchy and is 0.06±0.0025" thick.

The spine insert has a spine insert length that extends between the finger end and the wrist end and a spine insert width that extends between the first and second sides of the gripping portion. While the spine insert length extends between the finger end and the wrist end, it is understood that the finger tip of the spine insert does not necessarily extend all the way to the finger end of the gripping portion and the wrist tip of the spine insert does not necessarily extend all the way to the wrist end of the gripping portion. Similarly, while the spine insert width extends between the first and second sides of the gripping portion, it is understood that the spine insert width does not extend all the way between the first and second sides of the gripping portion. The preferred polypropylene webbing spine insert has a spine insert width of 0.75-1.25" and a spine insert length of 40-50% the side length of the gripping portion.

It is notable that the spine insert of the present invention is different from the inserts disclosed in the inventor's prior art. Specifically, U.S. patent application Ser. No. 12/660,856 discloses a palm arch support inserted between the layers of the gripping portion. The palm arch support addresses a different problem than the spine insert of the present invention, however. Indeed, while the spine insert must be flexible, the palm arch support "is neither soft nor cushioned, and conforms to neither the user's palm not the item the user grips" [¶ 0018]. The spine insert of the present invention, on the other hand, must be able to conform to the user's palm and the axle bar she is gripping in order for the grip assist of the present invention work. As detailed in ¶ 0042, moreover, the palm arch support covers a different portion of the user's palm than the spine insert of the present invention, and the present invention would not work as intended if it covered a similar portion.

In U.S. Pat. No. 10,098,393, an insert is also disclosed between the layers of the gripping portion. This insert also addressed a different problem than the spine insert of the present invention. The long, thin shape of the spine insert of the present invention is easily distinguishable over the preferred U-shaped insert of the prior art patent. The prior art patent does, however, disclose different shapes and sizes of the insert, so long as a gap in the insert is disposed over an area of vulnerability in the user's palm that is between subcutaneous fatty deposits that frame the palm. The spine insert of the present invention, however, being centered between the first and second sides, will be disposed directly over such an area of vulnerability, in direct opposition to the teachings of the prior art patent. In addition, while the prior art patent does disclose that the insert could be shaped as two strips, the spine insert of the present invention is always a single strip centered within the gripping portion and disposed over the area of vulnerability.

It is preferred that the gripping portion be made of non-slip material. The gripping portion may extend from the wrist portion as a rectangle with the first and second sides parallel and the finger end perpendicular to the first and second sides. The gripping portion may also include contouring for the thumb and pinky as disclosed in the inventor's prior art. It is preferred that an end piece be included at the finger end of the gripping portion between the two halves of material. It is preferred that the first and second attachment edges of the gripping portion are angled so that when the first and second straps of the wrist portion are secured about user's wrist via the wrist fastener, the first and second straps and the gripping portion form a funnel-shaped enclosure around the wrist and base of the hand, where the enclosure has an opening that is larger at its distal end than at its proximal end. It is preferred that the first and second straps of the wrist portion be substantially rectangular, "substantially" meaning here that the corners may be rounded, rather than perfect right angles. It is preferred that the means for fastening the straps around the wrist include a ring on the end of the first strap and sections of hook and loop-type fastener on the second strap, so that the second strap may be threaded through the ring of the first strap and then fastened to itself by way of its hook and loop-type fastener sections. It is preferred that each of the first and second straps include a cushioned pad for the comfort of the user. The cushioned pads are preferably formed of foam rubber covered by a low friction fabric.

It is preferred that the cushioned pad disposed on of the first and second straps be larger in size than those in the inventor's prior art. Specifically, this is preferred for the side of the hand and wrist where the thumb is disposed, as this is where most of the force will accrue with heavy weight lifting common with axle bars. The larger cushioned pad allows for greater force dispersion. It is also preferred that the other of the cushioned pads (i.e. the cushioned pad to be worn on the other side of the hand than the pinky finger) be slightly wider than those in the inventor's prior art, again adjusting for the larger axle bar and the greater force created by the greater weights.

It is preferred that the gripping portion be sufficiently pliable to allow itself to be easily wrapped around an axle bar prior to lifting and, with the aid of the spine insert, remain in a position so that the user can easily reach the finger end of the grip with her fingertips to again wrap the grip around the axle bar when the weightlifter is ready to lift. It is also preferred that the gripping portion have some rigidity independent from the spine insert. It is preferred that the two halves of material forming the gripping section be secured by stitching them together. It is also preferred that the stitching help to hold the spine insert in place.

When using a spring steel type spine insert, it is preferred that two protective inserts, manufactured of a thin abrasion resistant material, be included between the two halves of the gripping portion with one at each tip of the spring steel type spine insert, in order to protect the halves of the gripping portion from the relatively sharp ends of the spring steel type spine insert. It is also preferred that a palm insert be disposed between the halves of the gripping portion and the area proximate the wrist portion and extending past the top of the spine insert. In the preferred embodiment, the wrist tip of the spine insert is sandwiched between the palm insert and one protective insert and the second protective insert is folded over the top of the finger tip of the spring steel type spine insert. In alternative embodiments in which the palm insert is omitted, the protective inserts are folded over each tip of the spring steel type spine insert. In still other embodiments, the protective inserts and palm inserts are omitted altogether.

These aspects of the present invention are not meant to be exclusive and other features, aspects, and advantages of the present invention will be readily apparent to those of ordinary skill in the art when read in conjunction with the following description and accompanying drawings.

DETAILED DESCRIPTION

Figure 1:
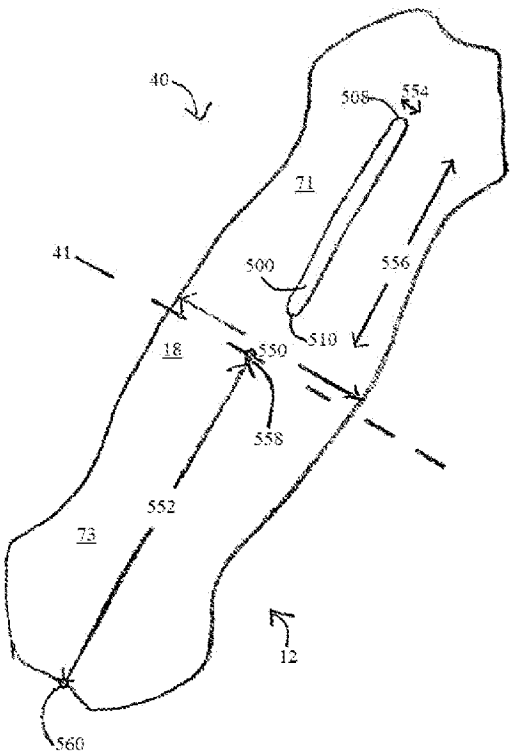
FIG. 1 is a view of the gripping portion unfolded.

Referring first to FIG. 1, an embodiment of the gripping portion 12 is shown before in an unfolded position. Finger end 18 has finger end width 550. Side length 552 extends from finger end center point 558 to wrist end center point 560. Spine insert 500 is placed on one of layer 71 or 73 and will be encased within layers 71, 73 when gripping portion is folded along line of symmetry 41. Spine insert 500 is preferably manufactured from a strip of annealed spring steel having a width of 5/16 inches, a thickness of 0.015 inches and a length of 5½ inches from wrist tip 508 to finger tip 510. Spine insert 500 has spine insert length 556 and spine insert width 554.

Gripping portion 12 is preferably made of a non-slip piece of material 40, such as chlorobutyl rubber, which provides a tacky, sticky surface to allow gripping portion 12 to adhere to the palm of the user's hand instead of sliding around while in use. The piece of material 40 is non-slip on at least the side that will face out when material 40 is folded. That is to say that the side of the material 40 that will be folded and flush against itself may or may not be non-slip material, but the side that faces out and will be in contact with the user's hand and/or axle bars is preferably non-slip.

Gripping portion 12 is preferably formed by adhering two layers 71, 73 of appropriately sized and shaped non-slip material together, preferably by folding over one piece of non-slip material 40 at line of symmetry 41, and stitching the two halves 71, 73 together. However, in one embodiment, the material is a moldable material, such as urethane, molded rubber or others, that is molded into the shape of at least the non-slip gripping portion 12. When folded along line of symmetry 41, gripping portion 12 has a rigidity such that it is self-supporting and will remain extended in front of the palm. Despite this rigidity, gripping portion 12 is sufficiently flexible to allow itself to be easily wrapped around an axle bar.

Figure 2B:
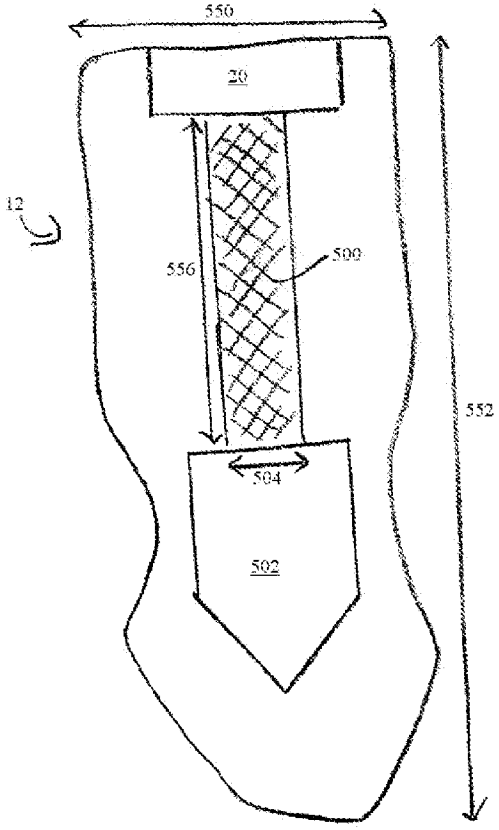
FIG. 2B is a view of the gripping portion of the preferred embodiment of the grip assist apparatus.
Figure 2A:
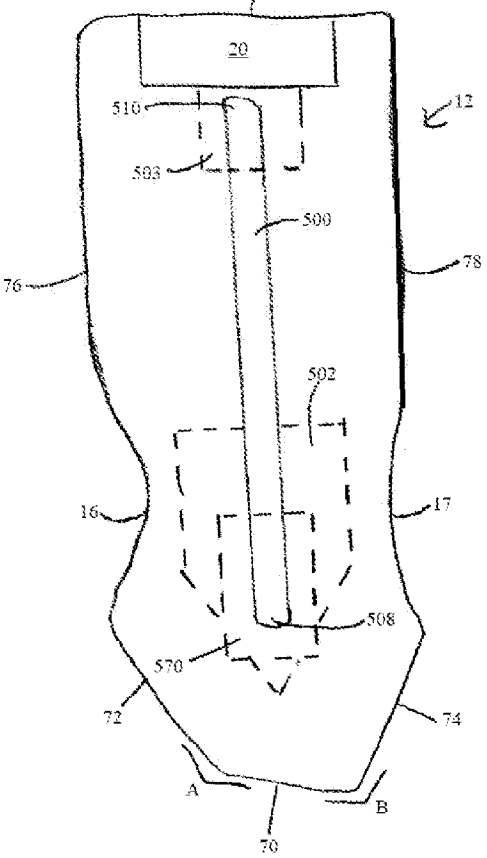
FIG. 2A is a view of the gripping portion with inserts superimposed.

Now referring to FIG. 2A, a preferred gripping portion 12 is shown with palm insert 502 and first and second protective inserts 503, 570 superimposed to show approximate placement. Gripping portion 12 is bound by finger end 18; first and second sides 76, 78; first and second attachment edges 72, 74; and wrist end 70. First and second sides 76, 78 are longer in the present invention than in comparable structures in the inventor's prior art. Specifically, side length 552 (shown in FIG. 1) is preferably between 7 and 9 inches, and preferably approximately 8 inches. First and second sides 76, 78 may include thumb contouring 16 and non-thumb contouring 17 to accommodate the user's thumb and the non-thumb sides of the hand, respectively. As shown, the non-thumb contouring 17 is shallower than the thumb contouring 16, but in some embodiments the gripping portion 12 is symmetrical, in which case the thumb contouring and non-thumb contouring 17 are mirror images of one another. As used herein, it is understood that "contouring" is a concave indentation in one of first and second sides 76, 78, adjacent to the applicable first or second attachment edge 72, 74. It is further understood that "thumb contouring" and "non-thumb contouring" are each a type of contouring, but thumb contouring is a deeper indentation than non-thumb contouring. In the preferred embodiment shown, wrist end 70 is angled at angle A from first attachment edge 72 and at angle B to second attachment edge 74, where angle A is greater than angle B so as to accommodate large thumb cushioned pad 504, as discussed below. In some embodiments, however, such as that shown in FIG. 3, gripping portion 12 is symmetrical and angle A and angle B are equal.

Gripping portion 12 may include palm insert 502 and first and second protective inserts 503, 570 placed between layers 71 and 72, as discussed with reference to FIG. 1. Spine insert 500 extends between finger end 18 and wrist end 70 and has corresponding spine insert finger tip 510 proximate to finger end 18 and a spine insert wrist tip 508 proximate to wrist end 70. Spine insert 500 may be curved into a preferred shape prior to lifting an axle bar, so that the user may manipulate finger end 18 with her fingertips, despite the extended length of sides 76, 78.

Gripping portion 12 also preferably includes end piece 20 at finger end 18. Spine insert 500 preferably extends toward finger end 18, but stops just shy of end piece 20. It is understood that in embodiments of gripping portion 12 that do not include end piece 20, spine insert 500 may extend further toward finger end 18 or all the way to finger end 18. On the other end of gripping portion 12, spine insert 500 preferably extends to approximately the intersection of sides 76, 78 with attachment edges 72, 74, but may extend further toward wrist end 70 or all the way to wrist end 70. Spine insert 500 is preferably parallel to sides 76, 78 and centered between them. As used herein, "centered" means exactly halfway between or within ½ inch on either side of being exactly halfway between.

In the preferred embodiment of FIG. 2A, protective inserts 503, 570 and a palm insert 502 are included within gripping portion 12 and are indicated in dashed lines. Palm insert 502 is preferably disposed between the wrist tip 508 of the spine insert 500 and the layer 71, 72 that will be the hand-facing side 514 (shown in FIG. 4). In other embodiments, however, palm insert 502 may be disposed between the wrist tip 508 and the other layer 71, 72 that will be the non-hand-facing side 516 (as shown in FIG. 5). The preferred palm insert 502 is made from red rubber having a thickness of 0.065 inches and a shape as shown in FIG. 2. However, other materials and shapes may also be utilized.

Protective inserts 503, 570 protect layers 71 and 72 from damage from the finger and wrist tips 508, 510 of spine insert 500, which although not particularly sharp, may be hard and may eventually wear away or damage layers 71, 72 with repeated use. The preferred protective inserts 503, 570 are made from a chlorosulphonated polyethylene material, such as those sold under the trademark HYPALON®, having a thickness of 0.020 inches and a substantially rectangular shape. This material is preferred due to its thin cross section and superior abrasion resistance.

As shown in FIG. 2A, when a palm insert 502 is used, it is preferred that wrist tip 508 of the spine insert 500 be sandwiched between the palm insert 502 and second protective insert 570. This provides a layer of protection between spine insert wrist tip 508 and layers 71, 72. It is preferred that first protective insert 503 is folded over the finger tip 510 of the spine insert 500. In embodiments in which a palm insert 502 is not included, first protective insert 503 is preferably folded over finger tip 510 and second protective insert 570 is folded over wrist tip 508. In still other embodiments, the palm insert 502 and protective inserts 503, 570 are omitted altogether.

FIG. 2A shows preferred shapes and relative sizes of palm insert 502 and protective inserts 503, 570. Palm insert 502 is shown as a larger "house" shape, with the roof pointing toward wrist end 70 but could be a relatively small rectangle to cover wrist tip 508. As used herein, "house shape" is a pentagon with two parallel sides; a third side connecting the two parallel sides and perpendicular to each; and fourth and fifth sides also connected respectively to the two parallel sides, where the fourth and fifth sides meet at an acute angle that "points" away from the third side and toward the wrist end 70. It is preferred that protective inserts 503, 570, be a smaller rectangle shape but, again, other shapes may be substituted. Palm insert 502 and protective inserts 503, 570 are each preferably made of thin (e.g. ⅙" or ⅛") rubber, but could be made of many materials that are durable and flexible, such as cardboard.

Now referring to FIG. 2B, the preferred gripping portion 12 is provided. Spine insert 500 is made from polypropylene webbing. Spine insert width 554 is greater than or equal to 0.75" and less than or equal to 1.25". Spine insert length 556 is 40-50% of side length 552. Although not shown, it is understood that spine insert 500 has a third dimension of thickness. The thickness of the preferred polypropylene webbing spine insert 500 is preferably greater than or equal to 0.0575" and less than or equal to 0.0625". The preferred gripping portion 12 includes end piece 20 and palm insert 502, and spine insert 500 extends therebetween and is adjacent to each. As used herein, when it is said that spine insert 500 is "adjacent" to end piece 20 and palm insert 502, it is understood that spine insert 500 extends between end piece 20 and palm insert 502 and that end piece 20 and palm insert 502 are the boundaries of the extension of spine insert 500. It is understood that some embodiments of gripping portion 12 include only spine insert 500 and not end piece 20 and/or palm insert 502. It is also understood that the spine insert width 554, length 556, and thickness may be greater than or less than the specific dimensions listed above. Protective inserts 503, 570 are generally not necessary with preferred polypropylene webbing spine insert 500, but may be included in some embodiments.

Figure 3:
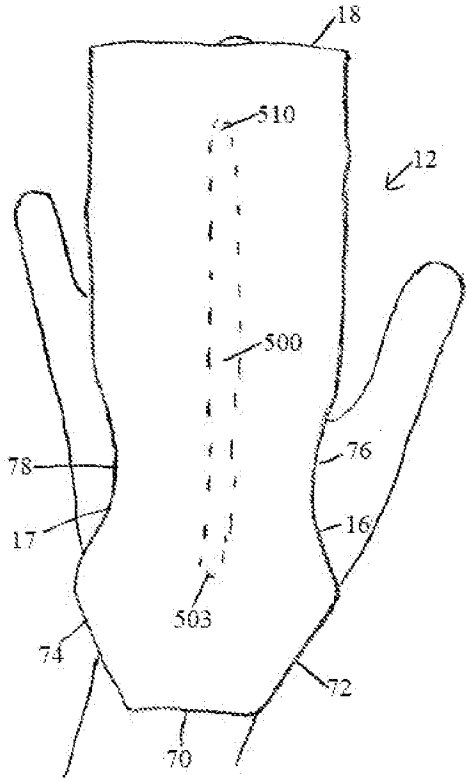
FIG. 3 is a view of the gripping portion superimposed over a hand.

Now referring to FIG. 3, gripping portion 12 is shown superimposed over a hand. The gripping portion 12 shown in FIG. 3 is symmetrical with thumb contouring 16 and non-thumb contouring 17 mirror images of one another and the angles between wrist end 70 and the respective attachment ends 72, 74 being equal. It is understood, however, that the non-symmetrical embodiment of gripping portion 12 shown in FIG. 2, for example, is preferred. The position of spine insert 500 within gripping portion 12 is indicated with dashed lines. The top of the user's middle finger is visible over finger end 18, but it is understood that many user's fingers would not extend above finger end 18 at all.

Figure 4:
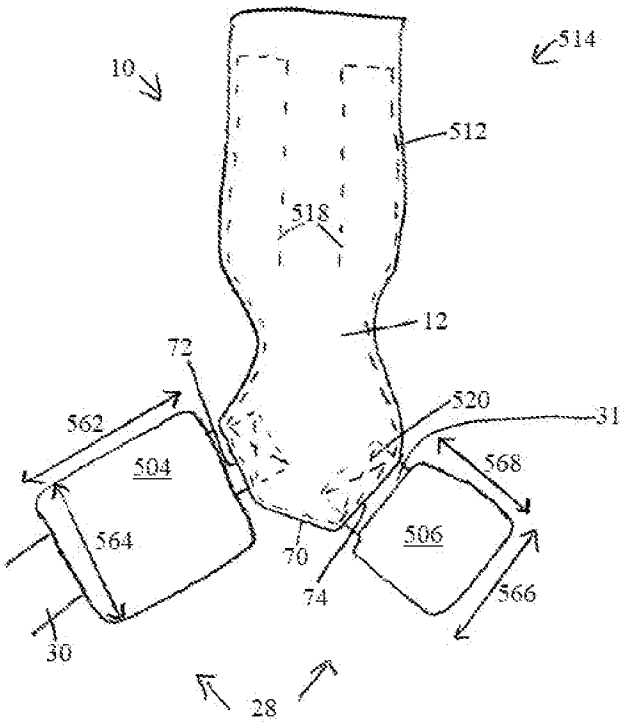
FIG. 4 is a view of the hand-facing side of the grip assist apparatus with stitching detail.
Figure 5:
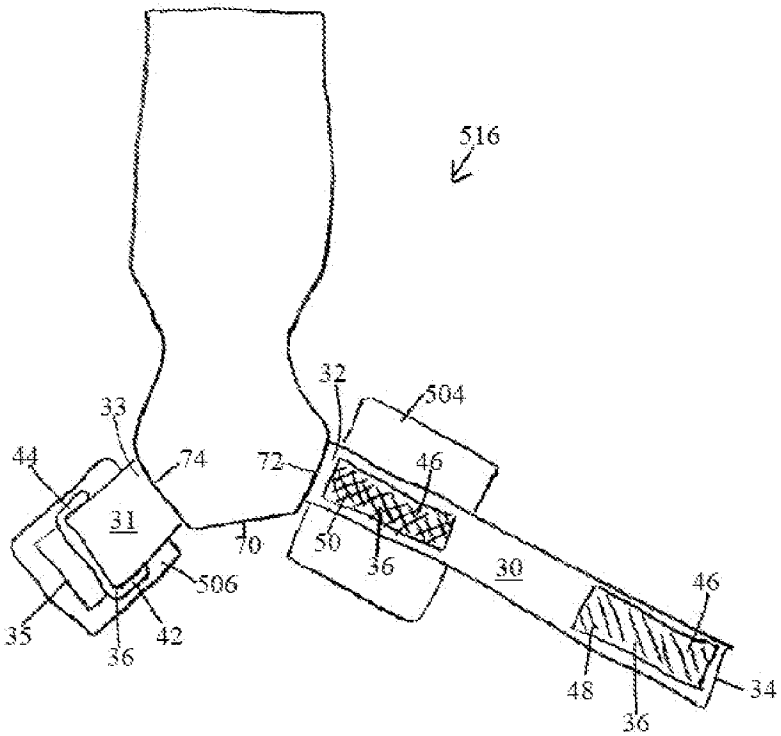
FIG. 5 is a view of the non-hand-facing side of the grip assist apparatus.

Now referring to FIG. 4, hand-facing side 514 of grip assist apparatus 10 is provided. The preferred means for holding layers 71, 73 together is stitching, including edge stitching 512 and stitching to help hold various inserts in place, such as spine stitching 518, which extends on either side of spine insert 500. It is preferred that spine stitching 518 goes through only first and second layers 71, 73 of gripping portion 12 and not through spine insert 500. As such, spine insert 500 is free to move within the space defined by spine stitching 518. This flexibility of movement allows spine insert 500 to move within gripping portion 12 to maintain the curl needed for the user to reach the finger end 18 of gripping portion 12 around the axle bar. As discussed below, attachment stitching 520 may be included to attach first and second straps 30, 31 to first and second attachment edges 72, 74.

Grip assist apparatus 10 also includes wrist portion 28 on either side of wrist end 70 of gripping portion 12. As shown in both FIGS. 4 and 5, when grip assist apparatus 10 is in use, wrist portion 28 securely and releasably wraps around the user's wrist. Wrist portion 28 includes first and second straps 30, 31, which are both preferably rectangular in shape. First strap 30 has free end 34 and attachment end 32, attached to first attachment edge 72 of gripping portion 12. Second strap 31 has free end 35 and attachment end 33, attached to second attachment edge 74 of gripping portion 12. Strap attachment ends 32, 33 may be attached to attachment edges 72, 74 by any means commonly used in the art, but preferably by inserting strap attachment ends 32, 33 between the halves 71, 73 of gripping portion 12 at the attachment edges 72, 74 and affixing strap attachment ends 32, 33 there by attachment stitching 520 and or gluing or other adhesion.

Straps 30, 31 also include a wrist fastener 36 to fasten wrist portion 28 about the user's wrist. Wrist fastener 36 preferably includes a second section 42 that includes a ring 44 on second strap 31. Wrist fastener 36 also preferably includes a first section 46 on first strap 31, which may be inserted through ring 44 to secure wrist portion 28. First section 46 preferably includes a first length 48 of loop-type fastener (shown as a patch with diagonal lines) and a second length 50 (shown as a patch with crisscrossed lines) of hook-type fastener so that when first strap 30 on which first section 46 is disposed is inserted through ring 44, first length 48 and second length 50 may be joined and releasably secured.

In the preferred embodiment, straps 30, 31 include thumb cushioned pad 504 and non-thumb cushioned pad 506 for the comfort of the user, designed to cushion the user's wrist on the thumb and non-thumb sides of her wrist, respectively. Cushioned pads 504, 506 are preferably formed of foam rubber covered by a low friction fabric. This is preferred because the fabric covering over the foam rubber allows the straps 30, 31 to slide over the cushioned pads 504, 506 and prevents straps 30, 31 from gripping onto the foam rubber. Thumb cushioned pad 504 is preferably larger than its comparable structure in the inventor's prior art. The larger thumb cushioned pad 504 allows for greater force dispersion. Thumb cushioned pad 504 has thumb pad width 564 of 3±0.5 inches and thumb pad length 562 of 2.75±0.5 inches (each shown in FIG. 4). Non-thumb cushioned pad 506 is preferably slightly wider than in the inventor's prior art, again adjusting for the larger axle bar and the greater force created by the greater weights. Non-thumb cushioned pad 506 has non-thumb pad width 566 of 2.75±0.5 inches and non-thumb pad length 568 of 2±0.5 inches.

Figure 6:
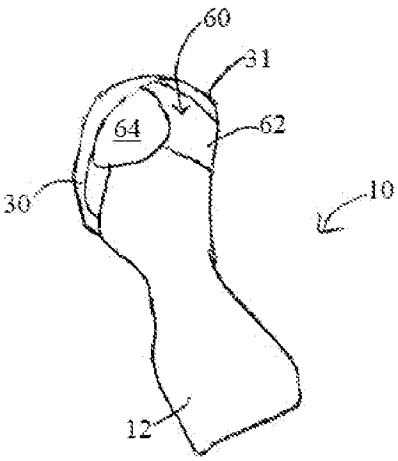
FIG. 6 is an isometric view illustrating the funnel-like opening of the grip assist apparatus of the present invention.

Now referring to FIG. 6, straps 30, 31 form a funnel-like opening 60 when attached to one another. Funnel-like opening 60 serves to grab the user's wrist in order to provide a firm support during strength training. Funnel-like opening 60 has a distal end 62 positioned around the base of the user's hand and a proximal end 64 positioned around the user's wrist. As distal end 62 is larger than proximal end 64, chafing of the base of the hand is prevented. Moreover, the nature of funnel-like opening 60 prevents circulation from being restricted in the user's hand while enabling grip assist apparatus 10 to be firmly attached to the user's wrist. It is noted that positioning the funnel like opening 60 about the base of the hand is preferred when the gripping apparatus is used during pulling exercises. However, when performing pushing exercises, the funnel like opening 60 is preferably positioned about the user's wrist and tightened to provide wrist support.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

I claim:

1. A grip assist apparatus for weight lifting comprising: a gripping portion formed by affixing first and second layers of flat material of a same shape and size to one another such that said first and second layers are flush, said gripping portion comprising:

a finger end having a finger end width;

a wrist end opposite from said finger end;

first and second attachment edges disposed on either side of said wrist end;

a first side extending between said first attachment edge and said finger end;

a second side extending between said second attachment edge and said finger end;

a side length, extending between a finger end center point and a wrist end center point;

a flexible spine insert disposed between said first and second layers, substantially perpendicular to said finger end and centered between said first and second sides, and extending between said finger end and said wrist end, wherein:

said spine insert is made of red rubber;

said spine insert comprises a spine insert width extending between said first and second sides;

said spine insert comprises a spine insert length extending between said finger end and said wrist end;

said spine insert length is substantially perpendicular to said finger end of said gripping portion;

and said spine insert width is greater than or equal to 0.75" and less than or equal to 1.25;

and vertical spine stitching extending parallel to said spine insert on left and right sides of said spine insert such that a gap is defined between distal ends of said vertical spine stitching closest to said finger end, substantially perpendicular stitching extending from each of said distal ends outwardly toward a respective one of said first and second sides, wherein: said vertical spine stitching goes through said first and second layers of said gripping portion and does not go through said spine insert such that said spine insert is free to move parallel to and between said vertical spine stitching; and a wrist portion comprising a first strap and a second strap, wherein:

each of said first strap and said second strap comprises an attachment end and a free end;

said attachment end of said first strap extends from said first attachment edge of said gripping portion;

said attachment end of said second strap extends from said second attachment edge of said gripping portion; and a releasable wrist fastener attached to said first and second straps, said wrist fastener being configured to fasten said-grip assist apparatus around a wrist of a user.

2. The grip assist apparatus as claimed in claim 1, wherein said red rubber of said spine insert is polypropylene webbing.

3. The grip assist apparatus as claimed in claim 1, wherein said spine insert length is 40-50% of said side length of said gripping portion.

4. The grip assist apparatus as claimed in claim 1, wherein at least one of said first and second sides comprises contouring.

5. The grip assist apparatus as claimed in claim 4, wherein said first side comprises thumb contouring.

6. The grip assist apparatus as claimed in claim 5, wherein said second side comprises non-thumb contouring.

7. The grip assist apparatus as claimed in claim 1, further comprising:

an angle A between said wrist end and said first attachment edge;

an angle B between said wrist end and said second attachment edge, wherein angle A is greater than angle B;

a thumb cushioned pad disposed on said first strap; and a non-thumb cushioned pad disposed on said second strap.

8. The grip assist apparatus as claimed in claim 7, wherein:

said thumb cushioned pad has a thumb pad width of 3±0.5 inches and a thumbpad length of 2.75±0.5 inches; and said non-thumb cushioned pad has non-thumb pad width of 2.75±0.5 inches and a non-thumb pad length of 2±0.5 inches.

9. The grip assist apparatus as claimed in claim 1, wherein said side length of said gripping portion is greater than or equal to 7" and less than or equal to 9".

10. The grip assist apparatus as claimed in claim 3, wherein said spine insert comprises a finger tip and a wrist tip and said finger tip of said spine insert is disposed adjacent to said finger end of said gripping portion.

11. A grip assist apparatus for weight lifting comprising: a gripping portion formed by affixing first and second layers of flat material of a same shape and size to one another such that said first and second layers are flush, said gripping portion comprising:

a finger end having a finger end width;

a wrist end opposite from said finger end;

first and second attachment edges disposed on either side of said wrist end;

a first side extending between said first attachment edge and said finger end;

a second side extending between said second attachment edge and said finger end;

a side length, extending between a finger end center point and a wrist end center point;

a flexible spine insert disposed between said first and second layers, substantially perpendicular to said finger end and centered between said first and second sides, and extending between said finger end and said wrist end, wherein:

said spine insert is made of metal;

said spine insert comprises a spine insert width extending between said first and second sides;

said spine insert comprises a spine insert length extending between said finger end and said wrist end;

said spine insert length is substantially perpendicular to said finger end of said gripping portion; and said spine insert length is greater than said spine insert width; and vertical spine stitching extending parallel to said spine insert on left and right sides of said spine insert such that a gap is defined between distal ends of said vertical spine stitching closest to said finger end, substantially perpendicular stitching extending from each of said distal ends outwardly toward a respective one of said first and second sides, said vertical spine stitching goes through said first and second layers of said gripping portion and does not go through said spine insert; and said spine insert is free to move parallel to and between said vertical spine stitching and slide relative to said first and second layers of said gripping portion; and a wrist portion comprising a first strap and a second strap, wherein:

each of said first strap and said second strap comprises an attachment end and a free end;

said attachment end of said first strap extends from said first attachment edge of said gripping portion; and said attachment end of said second strap extends from said second attachment edge of said gripping portion; and a releasable wrist fastener attached to said first and second straps, said wrist fastener being configured to fasten said grip assist apparatus around a wrist of a user.

12. The grip assist apparatus as claimed in claim 11, wherein said spine insert comprises a finger tip and a wrist tip and said gripping portion further comprises a first protective insert placed at said finger tip of said spine insert and a second protective insert placed at said wrist tip of said spine insert, wherein each of said first and second protective inserts are disposed between said first and second layers of said gripping portion.

13. The grip assist apparatus as claimed in claim 12, further comprising a palm insert placed at said wrist tip of said spine insert such that said wrist tip of said spine insert is disposed between said palm insert and said second protective insert.

14. The grip assist apparatus as claimed in claim 13, wherein said first protective insert is folded over said finger tip of said spine insert.

15. The grip assist apparatus as claimed in claim 12, wherein said first protective insert is folded over said finger tip of said spine insert and said second protective insert is folded over said wrist tip of said spine insert.

16. The grip assist apparatus as claimed in claim 12, wherein said first and second protective inserts are made of chlorosuiphonated polyethylene material.

17. The grip assist apparatus as claimed in claim 11, wherein said spine insert width is 5/16 of an inch and said spine insert length is 5.5 inches.

18. A grip assist apparatus for weight lifting comprising:

a gripping portion formed by affixing first and second layers of flat material of a same shape and size to one another such that said first and second layers are flush, said gripping portion comprising:

a finger end having a finger end width;

a wrist end opposite from said finger end;

first and second attachment edges disposed on either side of said wrist end;

a first side extending between said first attachment edge and said finger end;

a second side extending between said second attachment edge and said finger end;

a side length, extending between a finger end center point and a wrist end center point;

a flexible spine insert disposed between said first and second layers, substantially perpendicular to said finger end and centered between said first and second sides, and extending between said finger end and said wrist end, wherein:

said spine insert is made of cardboard;

said spine insert comprises a spine insert width extending between said first and second sides;

said spine insert comprises a spine insert length extending between said finger end and said wrist end;

said spine insert length is substantially perpendicular to said finger end of said gripping portion;

said spine insert width is greater than or equal to 0.75" and less than or equal to 1.25;

and vertical spine stitching extending parallel to said spine insert on left and right sides of said spine insert such that a gap is defined between distal ends of said vertical spine stitching closest to said finger end, substantially perpendicular stitching extending from each of said distal ends outwardly toward a respective one of said first and second sides, wherein: said vertical spine stitching goes through said first and second layers of said gripping portion and does not go through said spine insert such that said spine insert is free to move parallel to and between said vertical spine stitching; and a wrist portion comprising a first strap and a second strap, wherein:

each of said first strap and said second strap comprises an attachment end and a free end;

said attachment end of said first strap extends from said first attachment edge of said gripping portion;

said attachment end of said second strap extends from said second attachment edge of said gripping portion; and a releasable wrist fastener attached to said first and second straps, said wrist fastener being configured to fasten said grip assist apparatus around a wrist of a user.

19. The grip assist apparatus as claimed in claim 18, wherein said spine insert length is 40-50% of said side length of said gripping portion.

20. The grip assist apparatus as claimed in claim 18, wherein said spine insert comprises a finger tip and a wrist tip and said finger tip of said spine insert is disposed. adjacent to said finger end of said gripping portion.

21. A grip assist apparatus for weight lifting comprising:

a gripping portion formed by affixing first and second layers of flat material of a same shape and size to one another such that said first and second layers are flush, said gripping portion comprising:

a finger end having a finger end width;

a wrist end opposite from said finger end;

first and second attachment edges disposed on either side of said wrist end;

a first side extending between said first attachment edge and said finger end; a second side extending between said second attachment edge and said finger end;

a side length, extending between a finger end center point and a wrist end center point;

a flexible spine insert disposed between said first and second layers, substantially perpendicular to said finger end and centered between said first and second sides, and extending between said finger end and said wrist end, wherein:

said spine insert comprises a spine insert width extending between said first and second sides;

said spine insert comprises a spine insert length extending between said finger end and said wrist end; said spine insert length is substantially perpendicular to said finger end of said gripping portion; said spine insert width is greater than or equal to 0.75" and less than or equal to 1.25; and said spine insert length is 40-50% of said side length of said gripping portion;

and vertical spine stitching extending parallel to said spine insert on left and right sides of said spine insert such that a gap is defined between distal ends of said vertical spine stitching closest to said finger end, substantially perpendicular stitching extending from each of said distal ends outwardly toward a respective one of said first and second sides;

said vertical spine stitching goes through said first and second layers of said gripping portion and does not go through said spine insert; and said spine insert is free to move parallel to and between said vertical spine stitching and slide relative to said first and second layers of said gripping portion;

and a wrist portion comprising a first strap and a second strap, wherein:

each of said first strap and said second strap comprises an attachment end and a free end;

said attachment end of said first strap extends from said first attachment edge of said gripping portion; and said attachment end of said second strap extends from said second attachment edge of said gripping portion;

and a releasable wrist fastener attached to said first and second straps, said wrist fastener being configured to fasten said grip assist apparatus around a wrist of a user.

22. The grip assist apparatus as claimed in claim 21, further comprising an end piece disposed between said first and second layers at said finger end of said gripping portion, wherein said spine insert is adjacent to said end piece.

23. The grip assist apparatus as claimed in claim 21, wherein said spine insert comprises a finger tip and a wrist tip and said finger tip of said spine insert is disposed adjacent to said finger end of said gripping portion.

* * * * *